US007926117B2

(12) United States Patent
Parks et al.

(10) Patent No.: US 7,926,117 B2
(45) Date of Patent: Apr. 19, 2011

(54) BALLISTIC RESISTANT GARMENT QUICK RELEASE SYSTEM

(75) Inventors: Ardith D. Parks, Monticello, GA (US); Chung Hong Lu-Lai, Coral Springs, FL (US)

(73) Assignee: Point Blank Body Armor, Pompano Beach, FL (US)

( * ) Notice: Subject to any disclaimer, the term of this patent is extended or adjusted under 35 U.S.C. 154(b) by 83 days.

(21) Appl. No.: 12/233,946

(22) Filed: Sep. 19, 2008

(65) Prior Publication Data

US 2010/0071106 A1 Mar. 25, 2010

(51) Int. Cl.
*F41H 1/02* (2006.01)
*F41H 13/00* (2006.01)

(52) U.S. Cl. ..... 2/2.5; 2/102; 89/36.05

(58) Field of Classification Search ..... 2/2.5
See application file for complete search history.

(56) References Cited

U.S. PATENT DOCUMENTS

| | | | | | |
|---|---|---|---|---|---|
| 3,331,083 | A * | 7/1967 | Holly | 2/2.5 |
| 4,475,248 | A * | 10/1984 | L'Abbe et al. | 2/2.5 |
| H7 | H * | 1/1986 | Martone | 2/2.5 |
| 4,660,223 | A * | 4/1987 | Fritch | 2/2.5 |
| 4,989,266 | A * | 2/1991 | Borgese et al. | 2/2.5 |
| 5,073,985 | A * | 12/1991 | Stone et al. | 2/2.5 |
| 5,331,683 | A * | 7/1994 | Stone et al. | 2/2.5 |
| 5,373,582 | A * | 12/1994 | Dragone et al. | 2/2.5 |
| 5,966,747 | A * | 10/1999 | Crupi et al. | 2/466 |
| 5,978,961 | A * | 11/1999 | Barker | 2/2.5 |
| 6,164,048 | A * | 12/2000 | Rhodes | 54/1 |
| 6,266,818 | B1 * | 7/2001 | Howland et al. | 2/2.5 |
| 6,543,055 | B2 * | 4/2003 | Howland et al. | 2/2.5 |
| 6,659,689 | B1 * | 12/2003 | Courtney et al. | 405/186 |
| 6,698,024 | B2 * | 3/2004 | Graves et al. | 2/2.5 |
| 6,769,137 | B2 * | 8/2004 | D'Annunzio | 2/102 |
| 7,386,894 | B2 * | 6/2008 | Straiton | 2/228 |
| 7,401,363 | B2 * | 7/2008 | Hatfield et al. | 2/2.5 |
| 7,424,748 | B1 * | 9/2008 | McDunn et al. | 2/2.5 |
| 2008/0263737 | A1 * | 10/2008 | Parks et al. | 2/2.5 |
| 2009/0083892 | A1 * | 4/2009 | Parks | 2/46 |

* cited by examiner

*Primary Examiner* — Bobby H Muromoto, Jr.
(74) *Attorney, Agent, or Firm* — Seth H. Ostrow; Ostrow Kaufman LLP

(57) ABSTRACT

A ballistic resistant garment quick release system may include an outer shell configured to form a pocket into which ballistic resistant material is positioned. A cable channel is positioned along at least a portion of the ballistic resistant garment and a release cable is positioned within the cable channel. The release cable may move from a first position to a second position wherein the release cable is configured in the first position to engage a removable attachment strap and retain the removable attachment strap to the ballistic resistant garment and the release cable is configured in the second position to disengage from the removable attachment strap and thereby enable the removable attachment strap to disengage from the ballistic resistant garment. A fixed attachment strap is attached to the ballistic resistant garment and configured to mate with the removable attachment strap to retain the ballistic resistant garment on the user.

6 Claims, 8 Drawing Sheets

BALLISTIC RESISTANT GARMENT QUICK RELEASE SYSTEM

FIELD OF INVENTION

The present invention relates to body armor and more specifically to a ballistic resistant garment quick release system.

BACKGROUND

Ballistic resistant garments are available to protect various parts of the body from various ballistic threats, such as bullets or shrapnel. Some ballistic resistant garments are made of "soft armor," which is generally flexible. For example, ballistic resistant vests that are worn to protect a user's torso, and extremity protector that protect a user's arms or legs, are usually made of soft body armor. Other garments are made of "hard armor," which are generally stiff and inflexible. For example, helmets worn to protect a user's head are generally made of hard armor. However, some garments, such as vests and arm and leg protectors, may employ a combination of soft and hard armor to increase protection for the user. Traditionally, ballistic resistant garments have been single component garments or multiple-component garments that are not easily separable to remove quickly.

Ballistic resistant garments are often used in high threat situations, such as firefights or riots, by military or law enforcement personnel. In these situations, a user of these ballistic resistant garments must be adequately covered and the ballistic resistant garments must fit properly for maximum protection. However, a situation may occur in which the ballistic resistant garment must be quickly and easily removed from the user. For example, mission equipment carried on the ballistic resistant garment may become entangled during emergency egress from a vehicle, building or other confined space. In addition, the weight of the ballistic resistant garment and mission equipment may prevent the user from surfacing in the event of inadvertent water submersion. Further, if an individual is injured, a first responder may need to gain immediate access to the injured area for assessment and medical treatment.

Some ballistic resistant garments are configured to enable the ballistic resistant garment to break apart into several removable components. However, the mechanisms employed do not enable rapid or quick release of the garment, and may require the manipulation of multiple attachment mechanisms. Further, these mechanisms do not enable the quick release of any extremity protection.

Further still, some ballistic resistant garments provide the various components of the ballistic resistant garment, such as a vest, leg protection or arm protection, with long leads that extend a distance to a single release point or release area within the garment. These leads may have to be removed from the garment after the single release point, or release points in the release area, is disengaged. This may require more time to remove the vest, may cause the garment to become hung up on the user (e.g., the leads becoming entangled around the user), or may not fully disengage (e.g., the leads become entangled within the ballistic resistant garments).

SUMMARY

The present invention provides a ballistic resistant garment having an emergency release cable system that is readily accessible to a user or first responder and provides a relatively short pull distance to disengage the ballistic resistant garment from the user.

In general, in one aspect, the implementation of the disclosure features a ballistic resistant garment quick release system including a ballistic resistant garment configured to cover at least a portion of a user's body. The ballistic resistant garment may include an outer shell that may be configured to form a pocket into which ballistic resistant material may be positioned. A release cable may be configured in a first position to engage a removable attachment strap and retain the removable attachment strap on the ballistic resistant garment, and the release cable may be configured in a second position to disengage from the removable attachment strap and thereby enable the removable attachment strap to disengage from the ballistic resistant garment. A fixed attachment strap may be attached to the ballistic resistant garment and configured to mate with the removable attachment strap to retain the ballistic resistant garment on the user. When the cable is moved to the second position and the removable attachment strap disengages from ballistic resistant garment, the ballistic resistant garment may release from the user.

One or more of the following features may be included. The outer shell may further include a cable channel along at least a portion of the ballistic resistant garment into which the release cable is positioned. Further, the cable channel may be positioned within at least a portion of the pocket. Also, the cable channel may be positioned on an outer surface of the outer shell. In certain embodiments, the cable channel may be at least one fabric loop.

The release cable may engage the removable attachment strap at a release point. In certain embodiments, the release point may be configured to receive the removable attachment strap.

The ballistic resistant garment may be leg armor, arm armor, shoulder armor, ballistic chaps, ballistic shorts or ballistic pants. The ballistic resistant garment may include more than one component and the release cable may be positioned on each component. For example, the ballistic resistant garment may include an upper leg component and a lower leg component. In another example, the ballistic resistant garment may include an upper arm component and a lower arm component.

The removable attachment strap may include a length of fabric having a first end configured to mate with the fixed attachment strap and a passage at a second end configured to engage the release cable.

In general, in another aspect, the implementation of the disclosure may feature a ballistic resistant garment quick release system including a ballistic resistant garment configured to cover at least a portion of a user's body. The ballistic resistant garment may include an outer shell configured to form a pocket into which ballistic resistant material may be positioned. A cable channel may be positioned along at least a portion of the ballistic resistant garment and at least one release point may be positioned along a length of the cable channel configured to receive a removable attachment strap. A release cable may be positioned within the cable channel and be configured to move from a first position to a second position. The release cable may be configured in the first position to engage the removable attachment strap and retain the removable attachment strap within the at least one release point. The release cable may be configured in the second position to disengage from the removable attachment strap and thereby enable the removable attachment strap to disengage from the at least one release point. A fixed attachment strap may be attached to the ballistic resistant garment and be configured to mate with the removable attachment strap to retain the ballistic resistant garment on the user. When the cable is moved to the second position and the removable attachment strap disengages from the release point, the ballistic resistant garment may release from the user.

One or more of the following features may be included. The cable channel may be positioned within at least a portion of the pocket. The cable channel may be positioned on an outer surface of the outer shell. The cable channel may include at least one fabric loop.

The ballistic resistant garment may be leg armor, arm armor, shoulder armor, ballistic chaps, ballistic shorts or ballistic pants. The ballistic resistant garment may include more than one component and the release cable may be positioned on each component. For example, the ballistic resistant garment may be an upper leg component and a lower leg component. In another example, the ballistic resistant garment may be an upper arm component and a lower arm component.

The removable attachment strap may be a length of fabric having a first end configured to mate with the fixed attachment strap and a passage at a second end configured to engage the release cable.

In general, in yet another aspect, the implementation of the disclosure may feature a ballistic resistant garment quick release system including a ballistic resistant garment configured to cover at least a portion of a user's body. The ballistic resistant garment may include an outer shell configured to form a pocket into which ballistic resistant material may be positioned. A cable channel may be positioned along at least a portion of the outer shell within the pocket. A release cable may be positioned within the cable channel and configured to move from a first position to a second position. At least one removable strap may include a length of fabric having a first half of a removable connector at a first end and a passage at a second end that is configured to engage the release cable. At least one release point may be positioned along a length of the cable channel and may be configured to receive the second end of the removable attachment strap. The release cable may be configured in the first position to engage the passage in the removable attachment strap to retain the removable attachment strap at least partially within the cable channel at the at least one release point. The release cable may be configured in the second position to disengage from the passage in the removable attachment strap to enable the removable attachment strap to disengage from the cable channel at the at least one release point. At least one fixed attachment strap may be attached to the ballistic resistant garment and may have a second half of the removable connector configured to mate with the first half of the removable connector on the removable attachment strap to retain the ballistic resistant garment on the user. When the cable is moved to the second position and the removable attachment strap disengages from the cable channel, the ballistic resistant garment may release from the user.

One or more of the following features may be included. The ballistic resistant garment may be leg armor, arm armor, shoulder armor, ballistic chaps, ballistic shorts or ballistic pants. The ballistic resistant garment may include more than one component and the release cable may be positioned on each component. For example, the ballistic resistant garment may be an upper leg component and a lower leg component. In another example, the ballistic resistant garment may include an upper arm component and a lower arm component.

The invention may be implemented to realize one or more of the following advantages. The ballistic resistant garment quick release system enables the ballistic resistant garment to break away from the user, thereby enabling a user or a first responder to remove the ballistic resistant garment quickly from any position. The ballistic resistant garment quick release system is adaptable to any ballistic resistant garments employing straps, or similar retaining mechanisms. For example, the ballistic resistant garment quick release system may be adapted to leg armor, arm armor, shoulder armor, ballistic chaps, ballistic shorts and ballistic pants, among others. The ballistic resistant garment quick release system utilizes minimal components, thereby making the system easy to assemble and use. The design provides a ballistic resistant garment that may be donned and doffed by a user in the same manner as a non-quick release ballistic resistant garment, yet quickly removed in the event of an emergency.

Other features and advantages of the invention are apparent from the following description, and from the claims.

BRIEF DESCRIPTION OF THE DRAWINGS

Like reference numbers and designations in the various drawings indicate like elements.

DETAILED DESCRIPTION

Figure 1:
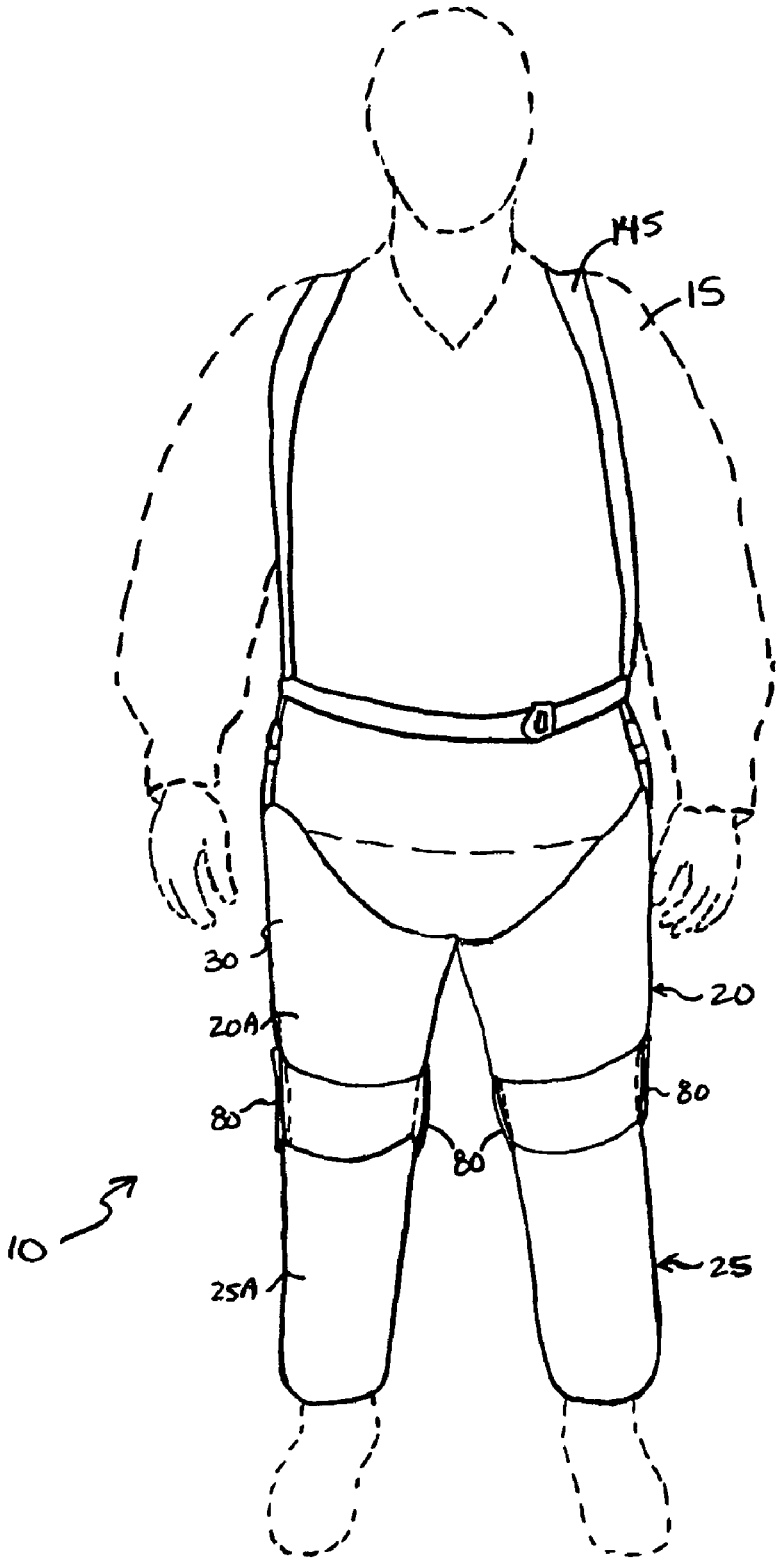
FIG. 1 is a front perspective view of an embodiment of a leg protector of the present invention.
Figure 2:
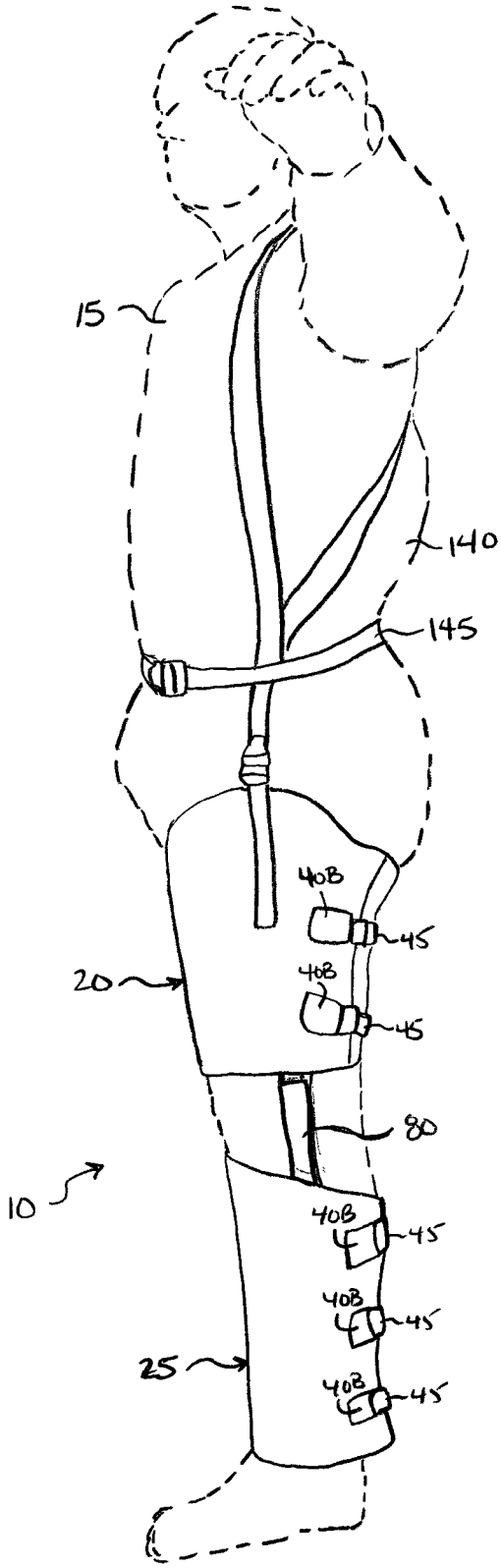
FIG. 2 is a side perspective view of the leg protector of FIG. 1.

As shown in FIGS. 1 and 2, a quick release leg armor system 10 may be worn by a user 15 to protect his leg from ballistic threats. The quick release leg armor system may include an upper leg armor component 20 and a lower leg armor component 25. Each of these components may include an outer shell 20A and 25A configured to form a pocket into which ballistic resistant material is placed (not shown). The ballistic material may include, for example, aramid, para-aramid, polypropylene, poly(p-phenylene-2,6-benzobisoxazole) or polyester, or any combination thereof, as well as hard armor.

Figure 3:
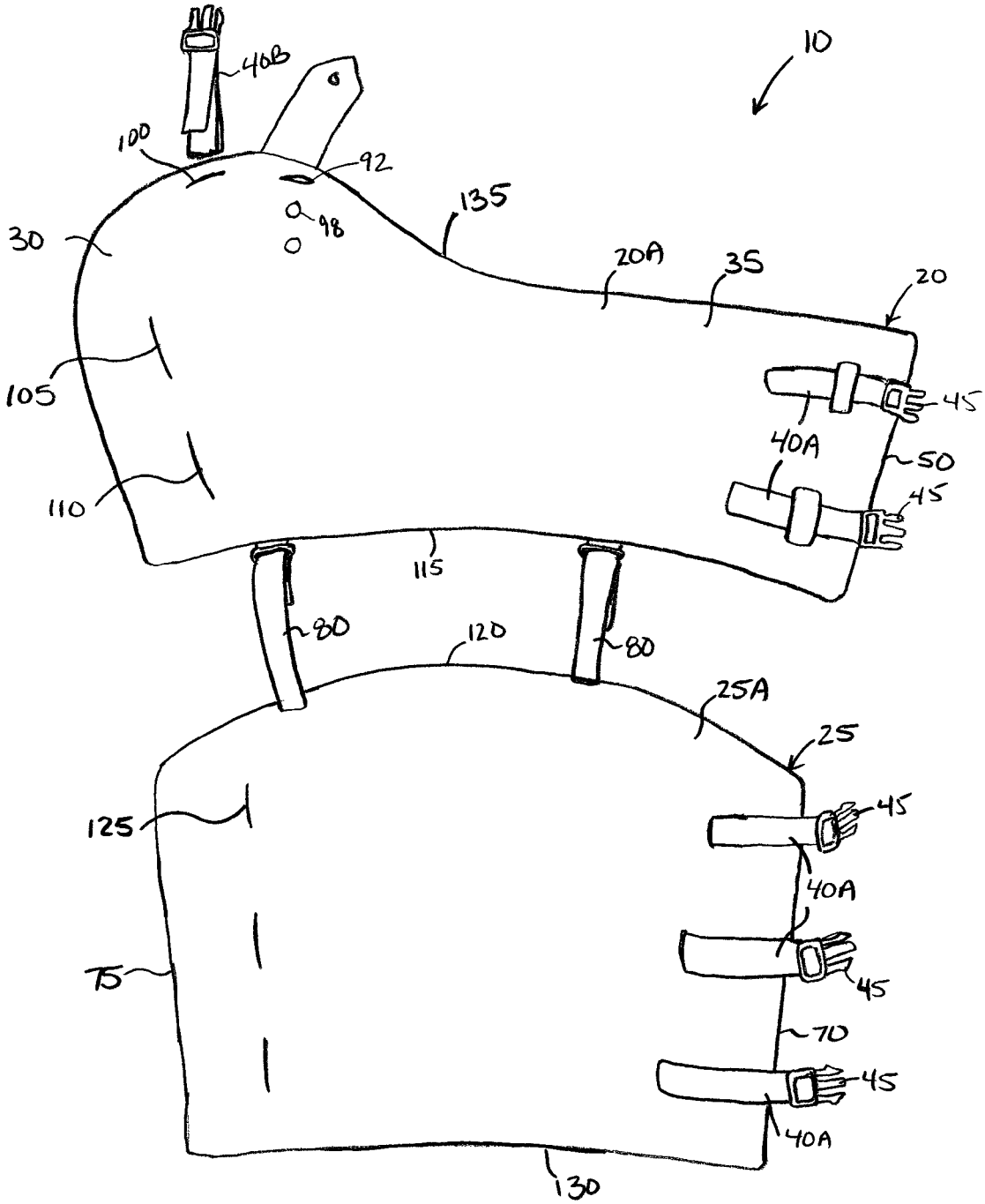
FIG. 3 is a front view of the leg protector of FIG. 1.

Referring also to FIG. 3, the upper leg armor component 20 may include a main portion 30 configured to protect an outer area of a user's leg and an elongated portion 35 configured to wrap around the users' leg. The elongated portion 35 may be wrapped around the user's leg and connected to the main portion 30 of the upper leg armor component 20 by mating attachment straps 40A and 40B. The attachment straps 40A and 40B may be made of a nylon webbing for strength and configured to releasably attach to each other by mating halves of removable connectors 45. The removable connectors 45 may be any suitable mating connectors, such as buckles, snaps, buttons or hook and loop tape.

Figure 4:
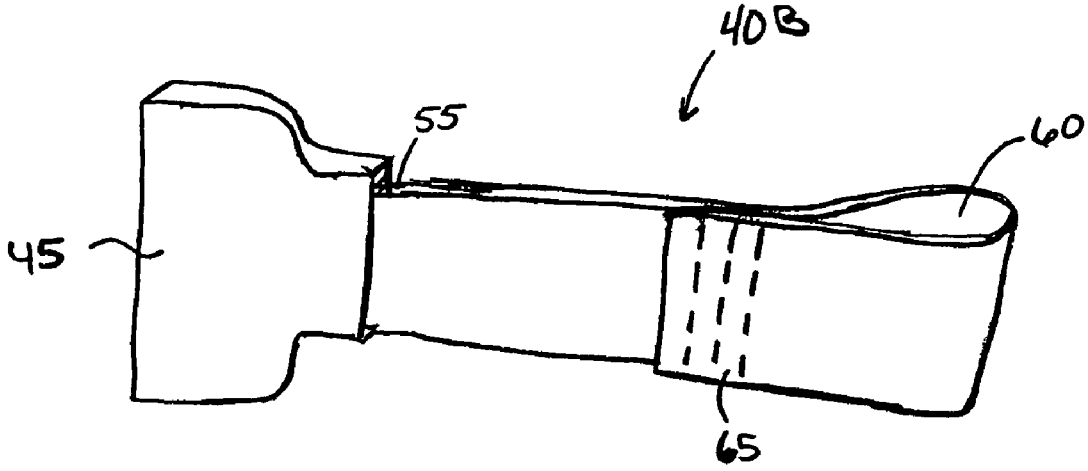
FIG. 4 is a perspective view of an embodiment of a removable attachment strap of the present invention.

For each mating pair of attachment straps 40A and 40B, one of the attachment straps 40A may be fixedly attached to the upper leg armor component 20 and the mating attachment strap 40B may be releasably attached to the upper leg armor component 20. For example, the fixed attachment strap 40A may be fixedly attached to the upper leg armor component 20 proximate to a distal end 50 of the elongated portion 35. The mating releasable attachment strap 40B may be configured to be releasably attached to the main portion 30, as described in detail below. Specifically referring to FIG. 4, the releasable attachment strap 40B may be made of a nylon webbing material and may include one half of the removable connector 45 at a first end 55. A passage 60 may be formed by folding a second end 65 of the releasable attachment strap 40B back onto, and affixing it to, itself. The second end 65 of the releasable attachment strap 40B may be affixed back onto itself by any suitable means, such as by sewing or adhesives. Although the passage 60 is described as being formed by folding the second end 65 back onto itself, the passage 60 may be formed by any suitable means. For example, in an alternative embodiment, the releasable attachment strap 40B may include an eyelet through the nylon webbing to form the passage 60.

Similarly, the lower leg armor component 25 is configured to wrap around the lower leg of a user, and may include a first edge 70 and a second edge 75. Attachment straps 40A and 40B may be similarly attached as described above to the lower leg armor component 25. For example, the fixed attachment straps 40A may be fixedly attached to the lower leg component 25 proximate to the first edge 70 while the releasable attachment straps 40B are releasably attached proximate to the second edge 75.

The upper leg armor component 20 and the lower leg armor component 25 may be attached to each other by unifying straps 80. Unifying straps 80 may be configured to enable the user to adjust the positional relationship between the upper leg armor component 20 and the lower leg armor component 25 to provide the user with the best possible fit both in terms of comfort and range of motion. For example, as can be seen in FIG. 1, the upper leg armor component 20 and the lower leg armor component 25 should be spaced apart enough to enable the user's knee to move freely.

Figure 5:
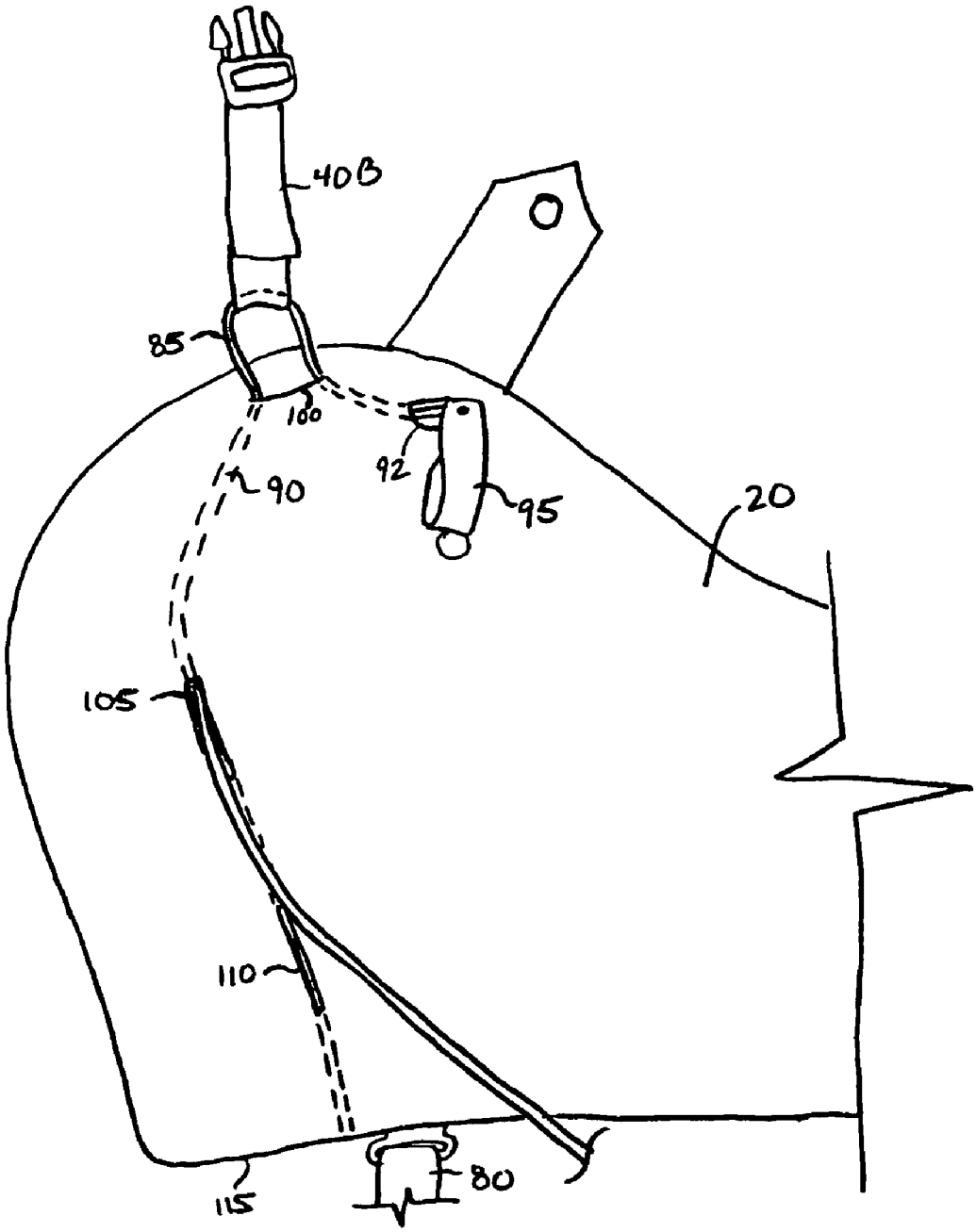
FIG. 5 is a front view of the leg protector of FIG. 1 showing a release cable being inserted.
Figure 6:
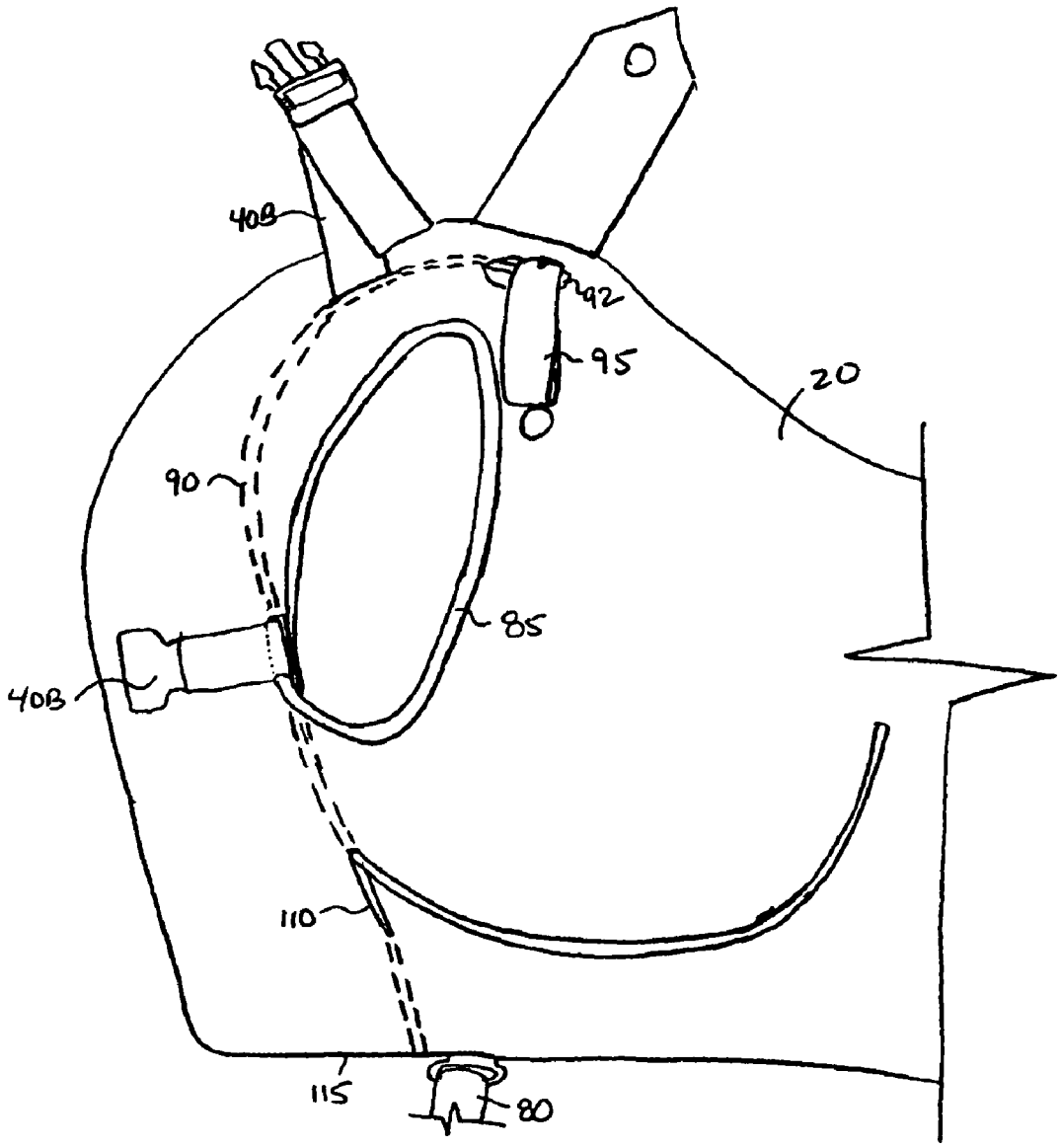
FIG. 6 is a front view of the leg protector of FIG. 1 showing the release cable being inserted.
Figure 7:
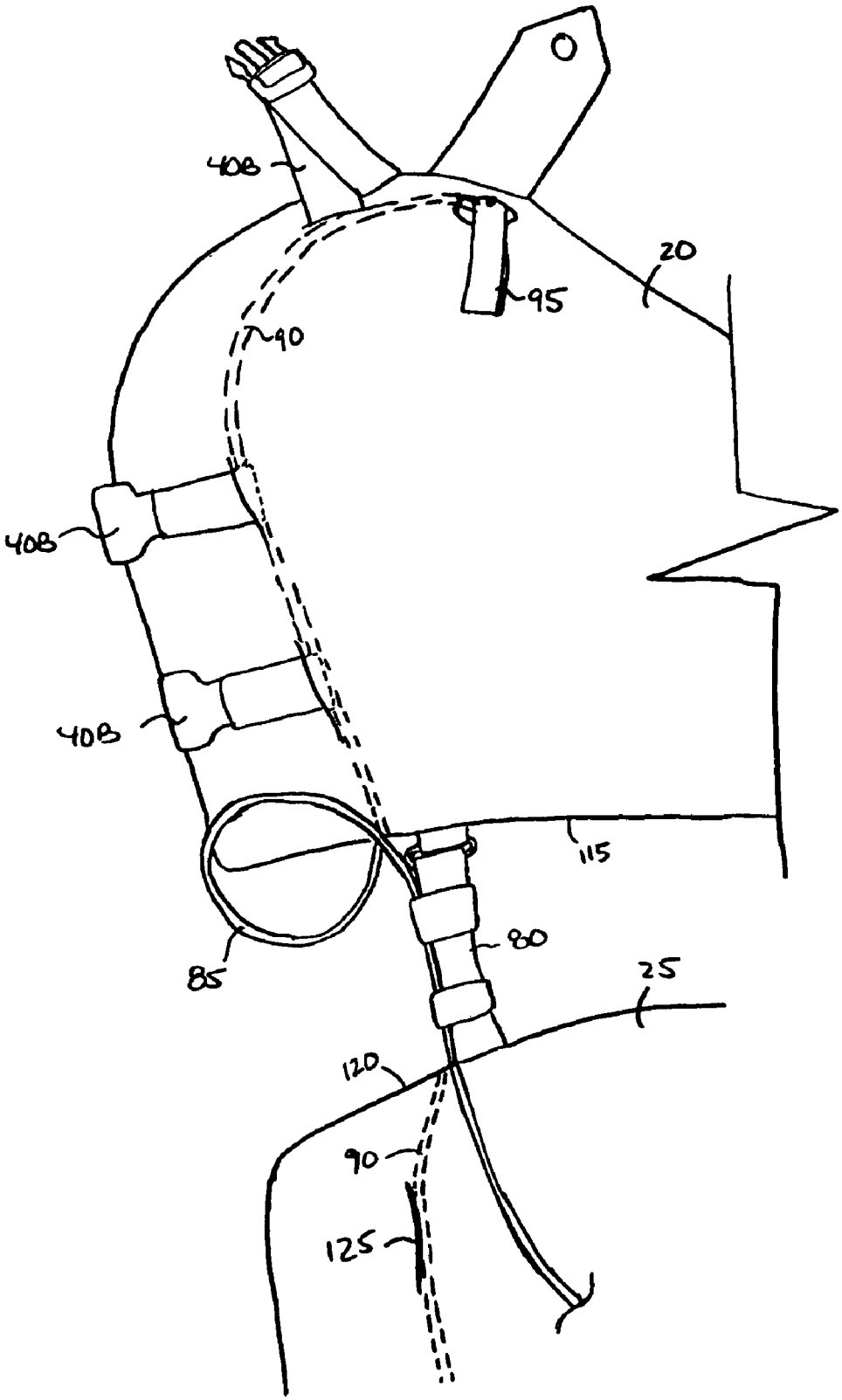
FIG. 7 is a front view of the leg protector of FIG. 1 showing the release cable being inserted.

Referring also to FIGS. 5, 6 and 7, a release cable 85 may be threaded into a cable channel 90 formed in the outer shells 20A and 205A of the upper leg armor component 20 and the lower leg armor component 25 by sliding the release cable 85 into the cable channel 90 at an entry point 92. A cable pull handle 95 may be attached at a proximal end of the cable 85. A distal end of the release cable 85 is fed into the cable channel 90 on the upper leg armor component 20 at the entry point 92. The distal end of the cable 85 is slid through the cable channel 90 and pushed out of a first release point 100, and all slack is removed between the entry point 92 and the first release point 100. The cable pull handle 95 may be removable attached to the upper leg armor component 20, such as by a snap 98 (shown in FIG. 3) or hook and loop fastener. The distal end of the release cable 85 is then threaded through the passage 60 of a releasable attachment strap 40B and back into the cable channel 90 at the first release point 100. The distal end of the release cable 85 is advanced to a second release point 105 and the cable is pulled out of the second release point 105 until the releasable attachment strap 40B at the first release point 100 is pulled into the cable channel 90 at the second release point 105. The distal end of the release cable 85 is then threaded through the passage 60 of another releasable attachment strap 40B and back into the cable channel 90. The distal end of the release cable 85 is advanced to a third release point 110 and the cable is pulled out of the third release point 110 until the releasable attachment strap 40B at the second release point 105 is pulled into the cable channel 90. This process is continued until all of the releasable attachment straps 40B are releasably attached to the upper leg armor component 20.

Once all the releasable attachment straps 40B are releasably attached to the upper leg armor component 20, the distal end of the release cable 85 is threaded through the remainder of the cable channel 90 in the upper leg armor component 20 and out of the upper leg armor component 20 proximate to a bottom edge 115 of the upper leg armor component 20 and into the cable channel 90 proximate to an upper edge 120 of the lower leg armor component 25. The distal end of the release cable 85 is guided and pushed out of a first release point 125 on the lower leg armor component 25, and all slack is removed. The distal end of the release cable 85 is then threaded through the passage 60 of a releasable attachment strap 40B and back into the cable channel 90 at the first release point 125 on the lower leg armor component 25. The process described above is repeated until all of the releasable attachment straps 40B are releasably attached to the lower leg armor component 25.

A user 15 may don the quick release leg armor system 10 by positioning the fully assembled (i.e., with the release cable 85 in position) quick release leg armor system 10 such that the upper leg armor component 20 is adjacent to his upper leg and the lower leg armor component 25 is adjacent to his lower leg. If the lower leg armor component 25 is to be joined to the upper leg armor component 20, the unifying straps 80 are connected between the lower leg armor component 25 and the upper leg armor component 20 before the quick release leg armor system is donned. The user 15 may position the main portion 30 of the upper leg armor component 20 adjacent to the outside of his upper thigh, wrap the elongated portion 35 around his leg and join the attachment straps 40A and 40B by connecting the mating portions of the removable connectors 45. The user 15 then may wrap the lower leg armor component 25 around his lower leg and join the attachment straps 40A and 40B by connecting the mating portions of the removable connectors 45. A user 15 my normally doff the quick release leg armor system 10 by first releasing the removable connectors 45 on the lower leg armor component 25 and then the upper leg armor component 20.

Figure 8:
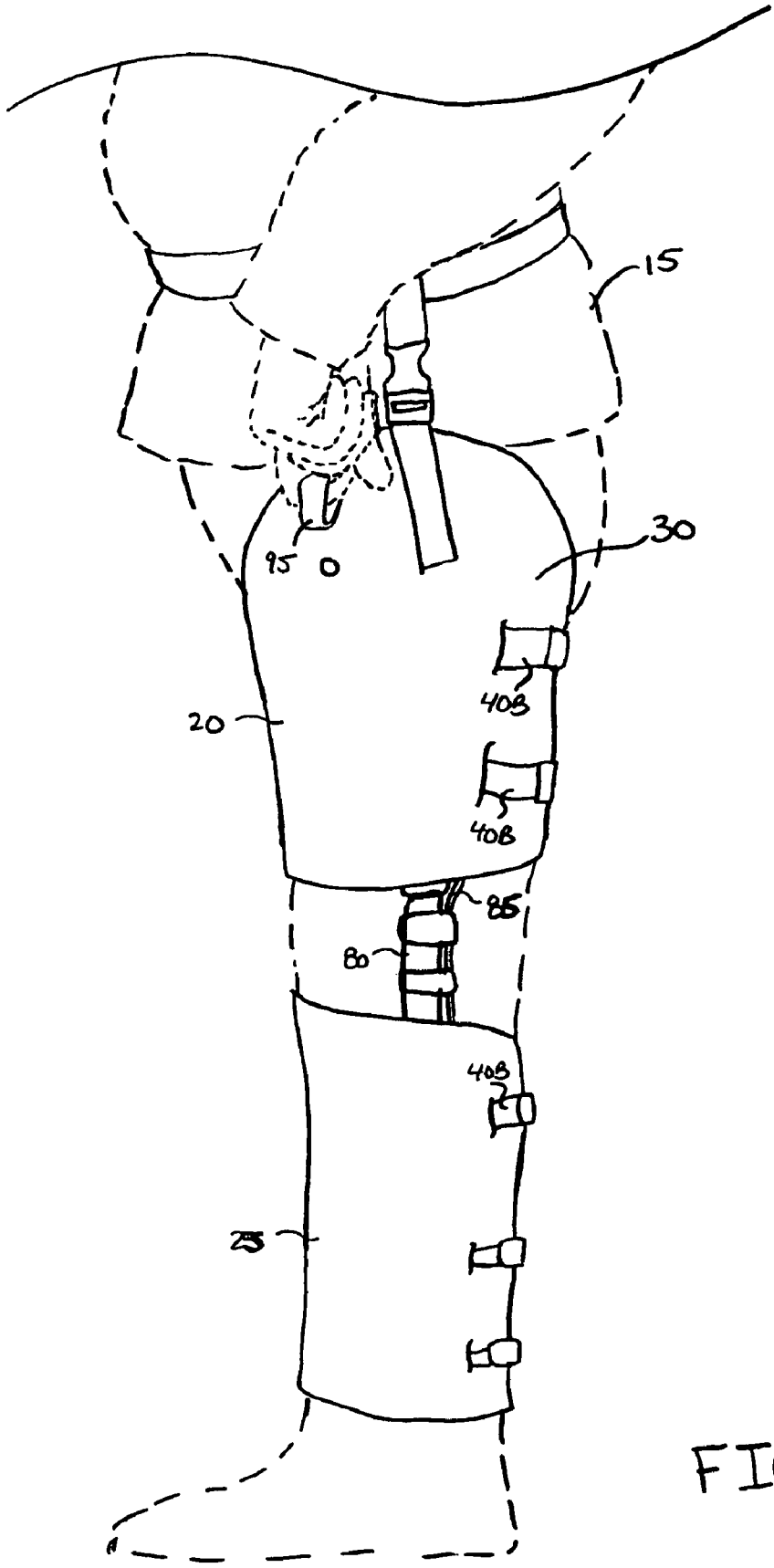
FIG. 8 is a side perspective view of the leg protector of FIG. 1 showing the release cable about to be deployed.

Referring to FIG. 8, a user 15 may quickly remove the quick release leg armor system 10 in an emergency situation by pulling on the cable pull handle 95 to remove the release cable 85 from the lower leg armor component 25 and then the upper leg armor component 20. As the user 15 pulls on the cable pull handle 95, the release cable 85 is removed from the passage 60 of each removable attachment strap 40B in sequence. In other words, because the distal end of the release cable 85 is adjacent to a lower edge 130 of the lower leg armor component 25, the distal end of the release cable 85 will be removed from the lowest removable attachment strap 40B first as the release cable 85 moves through the cable channel 90 upwards towards an upper edge 135 of the upper leg armor component 20. The distal end of the release cable 85 will continue to travel up the user's 15 leg and be removed from the removable attachment straps 40B from the bottom of the user's 15 leg to the top of the user's 15 leg. This enables the quick release leg armor system 10 to release from the bottom up, thereby alleviating the possibility that the quick release leg armor system 10 may drop down around the user's 15 leg while still being attached to the user's 15 lower leg and possibly cause a tripping hazard. Once all the removable attachment straps 40B are no longer retained by the release cable 85, the quick release leg armor system 10 will fall away from the user 15.

While the quick release leg armor system 10 has been described for one leg of a user 15, it is to be understood that two such systems would be used in conjunction to protect both legs of a user 15, as shown in FIGS. 1 and 2. When two quick release leg armor systems 10 are used, the components on each will be the same as described above, but may be configured as mirror images of each other. Further, the two quick release leg armor systems 10 may be connected adjacent to the upper edge 135 of the upper leg armor components 20 to configure the system to be worn more like pants. When a user releases the quick release leg armor system 10 from both legs, he may pull on the cable pull handle 95 located on each upper leg component 20.

The quick release leg armor system 10 may also be connected to a vest 140, suspenders 145, a belt (not shown) or any other garment worn by the user 15 and positioned above the user's 15 legs. Connecting the quick release leg armor system 10 to, for example, suspenders 145 may prevent the quick release leg armor system 10 from sliding down the user's 15 legs or further moving around the user's 15 legs. Since the quick release leg armor system 10 may be worn by military and law enforcement personnel, who are often in dangerous situations requiring a lot of movement, any movement in the quick release leg armor system 10 around the user 15 may cause limited mobility and/or discomfort. The quick release leg armor system 10 may be attached to, for example, the suspenders 145 using similar attachment straps 40A and 40B to enable the quick release leg armor system 10 to quickly release from the suspenders 145.

While the cable channel 90 has been described as an actual channel formed in the outer shells 20A and 205A of the upper leg armor component 20 and the lower leg armor component 25, the cable channel 90 may be formed of individual fabric loops within the outer shell. Further, the cable channel 90 may be formed on the outside of the outer shells 20A and 25A, either as a continuous channel, or individual fabric loops to guide the release cable 85. In another example, the release cable 85 may move freely within the outer shells 20A and 25A, and not be retained in any type of channel or fabric loops. In this example, the release cable 85 may move between the outer shells 20A and 25B and the ballistic resistant material within the outer shells 20A and 25A.

Further, while the quick release leg armor system 10 has been described as having both an upper leg armor component 20 and a lower leg armor component 25, it is to be understood that the quick release leg armor system 10 may be used with only an upper leg armor component 20. Further, while the quick release leg armor system 10 has been described as having an upper leg armor component 20 and a lower leg armor component 25, the system would work equally well on a one piece component, such as a ballistic panel that wrapped around all or a part of the user's leg. The quick release leg armor system 10 may also be used in lower extremity garments such as ballistic chaps, ballistic shorts or ballistic pants.

Also, while a quick release leg armor system 10 has been described, the mechanism described above of a release cable 85 passing through passages 60 in removable attachment straps 40B may be applied to a quick release upper extremity armor system which may include an upper arm component and a lower arm component. Similarly, the mechanism described above of a release cable 85 passing through passages 60 in removable attachment straps 40B may be applied to a quick release shoulder armor system.

It is to be understood that the foregoing description is intended to illustrate and not to limit the scope of the invention, which is defined by the scope of the appended claims. Other embodiments are within the scope of the following claims.

What is claimed is:

1. A ballistic resistant garment quick release system comprising:

a suspender having a loop at one end and a first half of a removable connector at the other end;

a first ballistic resistant garment having an elongated portion with a distal end and a proximal end, the first ballistic garment configured to wrap around at least a portion of a user's extremity and having an outer shell configured to form a pocket and a cable channel that extends between a top end and a bottom edge of the first ballistic resistant garment, the channel located at the proximal end of the first ballistic resistant garment, the channel having an entry point at the top end of the garment and an exit at the bottom edge of the garment, and a plurality of release points forming openings between the entry and the exit points of the channel;

a plurality of removable attachment straps having a loop at a first end and a second half of a removable connector at the other end;

ballistic resistant material positioned within at least a portion of the pocket;

a release cable in a first position threaded through the entry point, out from a first of the plurality of openings in the channel, through a loop at a first end of a first removable attachment strap, back into the channel at the first of the plurality of openings in the channel, out from a second of the plurality of openings in the channel, through a loop at a first end of a second removable attachment strap, back into the channel at the second of the plurality of openings in the channel, and out from the exit point at the bottom edge of the garment, a second half of the removable connector of the first of the plurality of removable attachment straps removably coupled to the first half of the removable connector of the suspender, the release cable configured to move from the first position to a second position, wherein the release cable is configured in the first position to engage the first and the second removable attachment straps and retain the removable attachment strap on the first ballistic resistant garment, and the release cable is configured in the second position to disengage from the first and the second removable attachment straps and thereby enable the suspender and the second removable attachment strap to disengage from the first ballistic resistant garment; and a fixed attachment strap attached to the distal end of the first ballistic resistant garment and configured to mate with the second removable attachment strap to retain the first ballistic resistant garment on the user.

2. The ballistic resistant garment quick release system of claim 1 comprising a second ballistic resistant garment having an upper edge and a bottom edge, a unifying strap that attaches the first ballistic garment to the second ballistic garment, a third removable attachment strap, and a fixed attachment strap attached to a distal end of the second ballistic resistant garment and configured to mate with the third removable attachment strap to retain the second ballistic resistant garment on the user, the second ballistic resistant garment having a cable channel that extents along at least a portion of a proximal end between the upper and the bottom edges of the second ballistic resistant garment, the cable channel having an entry point at the upper edge of the second garment, and a release point forming a third opening between the entry point and another point of the channel of the second ballistic resistant garment, and wherein the release cable in the first position is further threaded through the unifying strap and the entry point at the upper edge of the second garment, out from the third opening, through a loop of at a first end of the third removable attachment strap, and back into the third opening, the release cable in the second position configured to disengage from the third removable attachment strap and thereby enable the third removable attachment strap to disengage from the second ballistic resistant garment.

3. The ballistic resistant garment quick release system of claim 1 wherein the cable channel comprises at least one fabric loop.

4. The ballistic resistant garment quick release system of claim 1 wherein the ballistic resistant garment is chosen from the group consisting of leg armor, arm armor, shoulder armor, ballistic chaps, ballistic shorts and ballistic pants.

5. The ballistic resistant garment quick release system of claim 2 wherein the first ballistic resistant garment comprises an upper leg component and the second ballistic resistant garment comprises a lower leg component.

6. The ballistic resistant garment quick release system of claim 2 wherein the first ballistic resistant garment comprises an upper arm component and the second ballistic resistant garment comprises a lower arm component.

* * * * *